United States Patent [19]

Zalesak et al.

[11] 4,186,580

[45] Feb. 5, 1980

[54] APPARATUS FOR THE DISCHARGE OF WASTE ENDS OF BARS IN THE CROSS WEDGE ROLLING PROCESS

[75] Inventors: Jan Zálešák, Modrice; Jan Kovář Ricmanice, both of Czechoslovakia

[73] Assignee: Vyzkumny ustav tvarecich stroju a technologie tvareni, Brno, Czechoslovakia

[21] Appl. No.: 940,504

[22] Filed: Sep. 7, 1978

[30] Foreign Application Priority Data

Sep. 8, 1977 [CS] Czechoslovakia ..... 5854-77

[51] Int. Cl.[2] ..... B21H 9/00

[52] U.S. Cl. ..... 72/14; 72/71; 72/108

[58] Field of Search ..... 72/14, 71, 108, 250

[56] References Cited

U.S. PATENT DOCUMENTS

| | | | |
|---|---|---|---|
| 375,783 | 1/1888 | Tebbetts | 72/108 |
| 3,643,486 | 2/1972 | Hladky | 72/108 |
| 3,678,719 | 7/1972 | Tsukamoto et al. | 72/250 |

*Primary Examiner*—Lowell A. Larson

[57] ABSTRACT

There is disclosed apparatus for the discharge of unworkable waste bar ends adapted for use in the cross wedge rolling process to make possible a mechanized or automated production cycle. The disclosed apparatus comprises a guide connected to a swingable element controlled by a sensor and actuated by a motor, a channel for unworkable waste ends being arranged opposite the swingable element.

5 Claims, 5 Drawing Figures

APPARATUS FOR THE DISCHARGE OF WASTE ENDS OF BARS IN THE CROSS WEDGE ROLLING PROCESS

The present invention relates to apparatus for the discharge of unworkable waste bar ends especially in the cross wedge rolling process, to make possible a mechanized or automated production cycle.

The waste ends of bar stock in presently known cross wedge rolling apparatus which cannot be worked because they are shorter than the required length must be removed manually by tongs and put into a waste bin.

In addition to an unavoidable personal inspection and intervention into an otherwise mechanized or automated cycle, this operation disrupts the regularity of the production cycle proper and of the associated technological equipment which may depend upon such cycle.

These drawbacks are eliminated to a considerable extent by the apparatus according to the present invention. Such apparatus comprises a guide connected to a swingable element controlled by a sensor, the guide being activated by a motor which swings the guide to discharge a waste bar end into a channel therefor arranged opposite the swingable element.

A preferred embodiment of the apparatus of the invention for the discharge of unworkable waste ends of bar stock in cross wedge rolling apparatus is illustrated in the accompanying drawings, in which.

Figure 1:
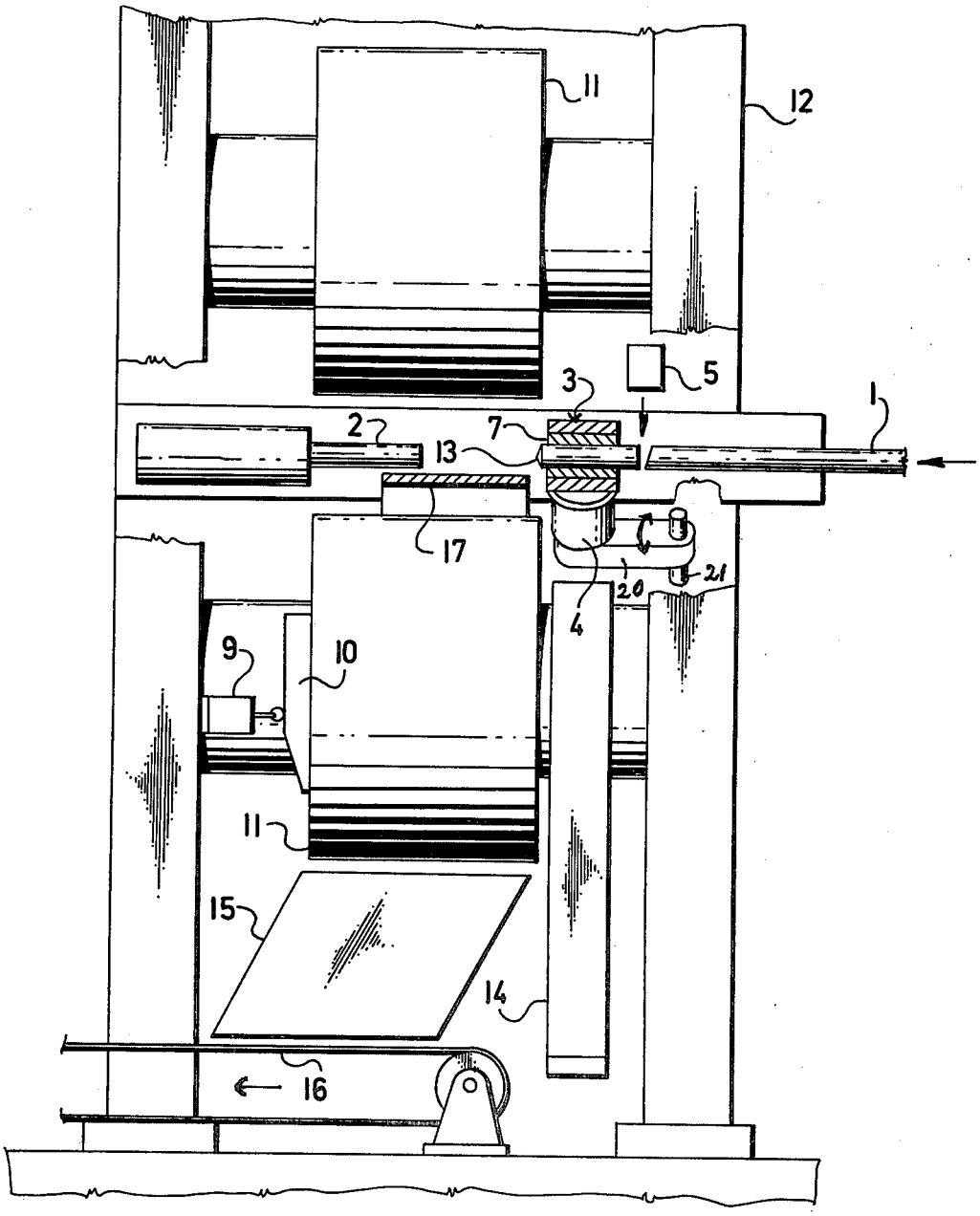
FIG. 1 is a schematic view in side elevation of cross wedge rolling apparatus with an in-built guide end swingable element for receiving waste ends of bar stock.
Figure 2:
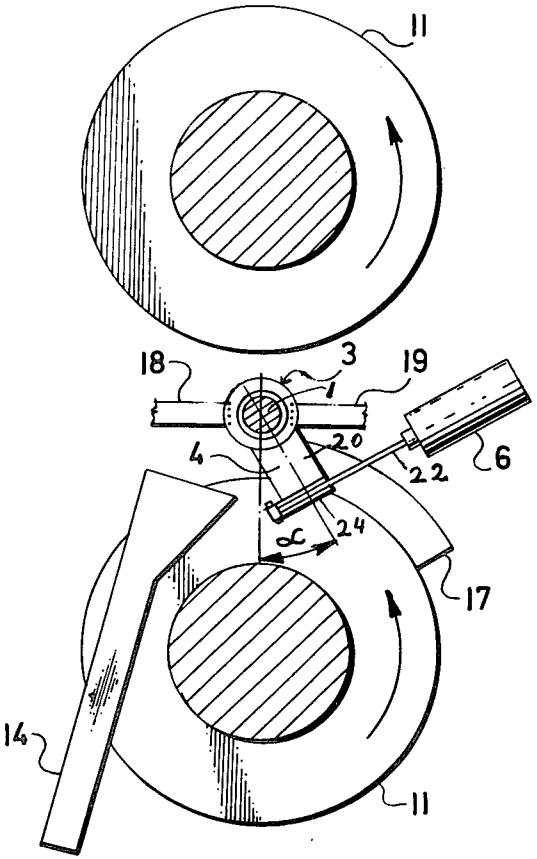
FIG. 2 is a fragmentary view in vertical transverse section of the apparatus of FIG. 1 with the guide and swingable element in their rest positions.

Turning now to the drawings, there is shown a cross wedge rolling mill stand having a frame 12 in which there are journalled two spaced parallel horizontal working roll 11 which are driven in the same direction by driving means (not shown). For simplicity, only a directing segment 17 on the lower working roll 11 is shown; it is to be understood that both working rolls have suitable cross wedge rolling tools mounted thereon, and that the upper working roll has a directing segment thereon similar to segment 17 and cooperating therewith. Bar stock 1 is advanced toward the mill stand in the direction from right to left as indicated by the arrow in FIG. 1, in the embodiment of FIGS. 1, 2, and 3 the bar being received within a guide 3 having a sleeve 7 therewithin. In its normal position the guide 3 is disposed as shown in FIGS. 1 and 2, thereby permitting the axial advance of bar stock 1 of the requisite length into the working zone between the tools on the rolls 11. The length of advance of the bar stock 1 into the mill between the gap presented between rolls 11 is determined by an adjustable gauge 2 which is disposed at the left of the mill stand in FIG. 1 in axial alignment with the bar stock 1 being advanced into the mill. Such feeding of the continuous bar stock is timed by an adjustable cam 10 on one of the rolls 11, in this case the lower roll, cam 10 coacting with a microswitch 9 so that the bar stock 1 is fed between the rolls 11 at the time when a gap is presented between them. It is to be understood that after the bar stock has been thus fed between the rolls, the portion thereof between the rolls is then cut off as by one or more cutting tools (not shown) on the rolls 11. After the thus cut portion of the bar stock has been worked by the tools on the rolls 11 during a portion of one revolution thereof, it is discharged from the pass between the rolls onto a chute 15 from which is falls onto a conveyor 16 to be fed away from the millstand.

As shown in FIG. 2 the end of the bar stock which is fed into the mill stand between the working rolls is suitably guided in the working zone of the mill by opposed guides or gibs 18 and 19. Such portion of the bar stock is also guided by the roll pass entering segments 17 of the working tools on the rolls 11.

As shown in FIG. 1, the guiding sleeve 7 is positioned immediately to the right of the working rolls 11. Sleeve 7 mounted upon a swingable element 4 which in turn is mounted upon the left hand end of an arm 20 which is mounted upon an oscillatable stub shaft 21. The sleeve 7 and the swingable element 4 are so mounted as to permit their being swung from the normal position shown in FIGS. 1 and 2 to that shown in FIG. 3. Such swinging is effected by a selectively operated reciprocating fluid motor 6 the piston rod 22 of which is pivotally connected to a further arm 24 affixed to the arm 20. When the piston in the motor 6 lies adjacent its outer terminus (FIG. 2) the guide 3 is disposed in axial alignment with a path upfeeding of the bar stock 1. When the piston in motor 6 lies adjacent its inner terminus (FIG. 3) the guide 3 is tipped as shown so that a waste bar end 13 disposed therewithin is discharged into the funnel-like upper end of a discharge channel 14 from which it is forwarded to further handling and/or feeding apparatus (not shown).

Figure 3:
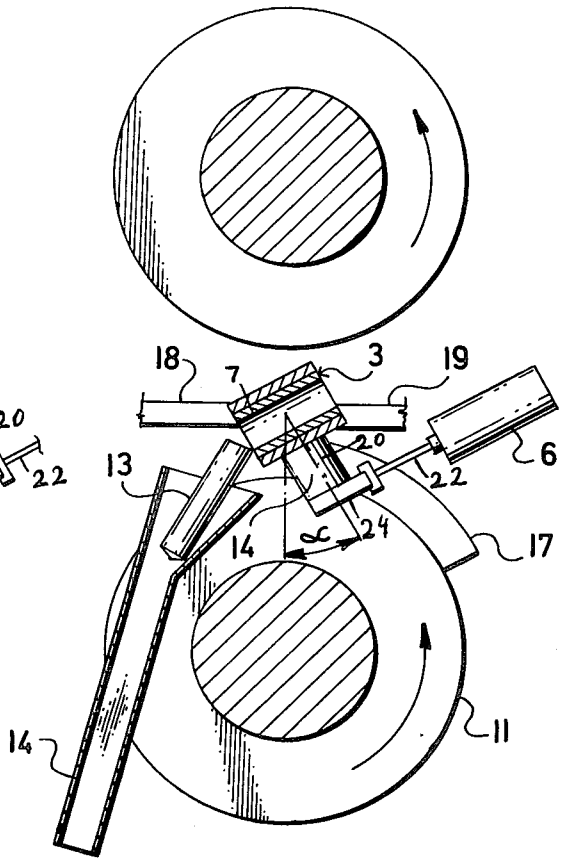
FIG. 3 is a view similar to FIG. 2 but with the swingable element being shown in swung out position with the unworkable waste bar stock end being discharged.

The operation of the fluid motor 6 selectively to swing the guide 3 between the positions of FIG. 2 and FIG. 3 is under the control of a sensor generally shown at 5 in FIG. 1. Sensor 5, which may be of the photoelectric type including a light source and a light receiving photoelectric cell, detects a discontinuity in the bar stock 1 being fed therepast. As shown in FIG. 1, wherein an unworkable waste end 13 of the bar stock has been thrust into the guide 3 by the leading end of a succeeding bar stock member 1.

When the sensor 5 detects the condition shown in FIG. 1, which occurs during the time that the bar stock is being fed into the gap between the working tools on the rolls 11, it feeds pressured fluid into the left hand end of the motor 6 to tip the guide 3 into the position thereof shown in FIG. 3 so as to discharge the waste bar 13 into the channel 14. Before the next feeding stroke imposed upon the bar stock 1, the timing of which is governed by interaction of the cam 10 and the switch 9, pressure fluid is discharged from the left hand end of motor 6 and introduced into the right hand end thereof, whereby to return the guide 3 into the position thereof shown in FIGS. 1 and 2. The control circuit including the sensor 5 and the switch 9 is so arranged that such feeding of the bar stock 1 cannot take place until the guide 3 has resumed its normal position (FIGS. 1 and 2).

As above indicated, the apparatus of the invention may be used to advantage in mechanized or automated cross wedge rolling. With minor modifications, it may also be used in the feeding of work pieces to various stages of multi-stage automatic presses. It is to be understood that the fluid motor 6 may be replaced by an electromagnet or other know devices for swinging the guide 3.

Figure 5:
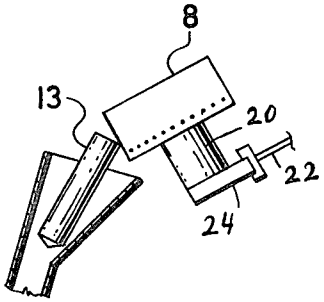
FIG. 5 is a fragmentary view in end elevation showing the alternative guide of FIG. 4 in tipped position and discharging a waste bar end into a fragmentarily shown discharge channel.
Figure 4:
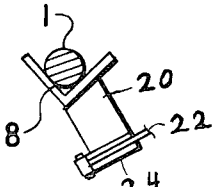
FIG. 4 is a fragmentary view in end elevation of an alternative guide for waste bar ends, a bar end resting therein being shown in section.

The guide 3, which is the form of a sleeve, may be replaced by guides of other shapes. One such guide, of V shape, is shown at 8 in these figures. Parts in FIGS. 4 and 5 which are similar to those in FIGS. 1–3, inclusive, are designated by the same reference characters. Other guides of open-topped multi-sided or part-circular configuration may also be employed for such guides.

Although the invention is illustrated and described with reference to a plurality of preferred embodiments thereof, it is to be expressly understood that it is in no way limited to the disclosure of such a plurality of preferred embodments, but is capable of numerous modifications within the scope of the appended claims.

I claim:

1. In an apparatus for the step-wise feeding axially of an elongated work piece to a mechanism which works upon it while the work piece is axially at rest between feeding steps, the improvement which comprises a guide for the work piece disposed upstream of the mechanism adjacent thereto, means mounting the guide for swinging between the first position in which the guide is aligned with the path of step wise travel of the work piece and a second, tipped position in which the guide is disposed at a substantial angle respect to such path, and means responsive to a discontinuity in the work piece immediately upstream of the guide for swinging the guide into its second position, whereby the portion of the work piece supported by the guide travels down the guide and is removed from the path of feeding of the work piece.

2. Apparatus according to claim 1, comprising a channel disposed beneath the guide for receiving the portion of the work piece which is removed from the guide.

3. Apparatus according to claim 1 wherein the angel of tipping of the guide in its second position exceeds the angle of repose between the work piece and the guide, and the portion of the work piece supported by the guide falls from it under the influence of gravity.

4. Apparatus according to claim 1, wherein the mechanism is a cross wedge rolling mill having working rolls presenting a gap between them at one angular position of the rolls, the work piece is bar stock, and the bar stock is fed into the gap between the rolls.

5. Apparatus according to claim 4, wherein the mechanism includes first circuit means for timing the feeding of the bar stock so that the bar stock is presented to the gap between the rolls, and the sensing means includes second circuit means connected to the first circuit means and preventing feeding of the bar stock to the mill unless the guide is in its first position.

* * * * *